US005184108A

United States Patent [19]

Bloom et al.

[11] Patent Number: 5,184,108

[45] Date of Patent: Feb. 2, 1993

[54] CONDUCTIVE CORNERS FOR SURGE SURVIVAL

[75] Inventors: Terry Bloom, Middlebury; Craig Ernsberger, Granger, both of Ind.

[73] Assignee: CTS Corporation, Elkhart, Ind.

[21] Appl. No.: 638,443

[22] Filed: Jan. 2, 1991

[51] Int. Cl.[5] ..... H01C 10/10

[52] U.S. Cl. ..... 338/195; 338/260; 338/277; 338/20; 338/21; 29/610.1

[58] Field of Search ..... 338/195, 260, 20, 21, 338/277; 29/610.1

[56] References Cited

U.S. PATENT DOCUMENTS 2,338,458 1/1944 Scmade .
2,356,512 8/1944 Gieffers .
2,359,757 10/1944 Gieffers .
2,682,596 6/1954 Cox et al. .
2,910,664 10/1959 Lanning .
3,468,011 9/1969 Curtis .
4,245,210 1/1981 Landry et al. ..... 338/314
4,613,844 9/1986 Kent et al. ..... 338/314
4,647,900 3/1987 Schelhorn et al. ..... 29/610.1
4,812,419 3/1989 Lee et al. ..... 338/195 X

*Primary Examiner*—Marvin M. Lateef
*Attorney, Agent, or Firm*—Albert W. Watkins

[57] ABSTRACT

Conductive material is applied to a resistor to provide controlled shunting of current from localized regions of the resistor that would otherwise destructively fail during surge. Various embodiments are disclosed having varying resistance, dimension and placement. The continuity of the original resistor material is not altered, nor is the current diverted in such as way as to create a new localized regions that might destructively fail. The resistors so designed have application in lightning surge environments, power supply and power input circuitry and other applications where potential short duration surges might otherwise cause destructive failure of standard resistors.

15 Claims, 2 Drawing Sheets

CONDUCTIVE CORNERS FOR SURGE SURVIVAL

BACKGROUND OF THE INVENTION

1. Field of the Invention

This invention pertains to electrical resistors generally and specifically to resistor configurations that are, on occasion, subjected to large surges of electrical energy.

2. Description of the Related Art

Electrical resistors may be formed using a variety of processes such as screen printing, vapor deposition, compaction, lamination, and immersion plating. Film type resistors, herein considered to be resistors that have a thin film of resistive material deposited upon a non-conductive substrate, are most commonly formed from vapor deposition and screen printing techniques. Other processes to form resistors, such as winding and compaction, result in carbon pile, wire-wound, and other resistors.

In electrical applications electrical transients occasionally occur upon failure of components, applied voltage surges such as improper connection of a power source, or induced signals from neighboring equipment. Transients of sufficient magnitude can cause failure of resistors, including resistors that form a part of circuitry specifically designed to protect other circuitry from the surge. Transients of large magnitude often adversely affect film type resistors.

A resistor that has failed because of an electrical surge usually has tell-tale signs. Electrically generated thermal energy usually concentrates about one or several localized regions. The localized heating may cause separation of the resistive material from the substrate, separation of the resistive material, separation of the substrate material, drift in the resistance component value, or a melting or fusing of materials. The prior art in U.S. Pat. No. 2,910,664 to Lanning, U.S. Pat. No. 3,468,011 to Curtis, U.S. Pat. No. 4,245,210 to Landry et al., and U.S. Pat. No. 4,647,900 to Schelhorn et al. discuss various methods for reducing the ill effects of surges.

Lanning discloses the formation of a particular termination geometry that extends transversely to a resistor element to prevent current crowding from occurring in the resistor material close to the termination. In this disclosure, any design changes influence the performance of a resistor only at the terminations. While in some applications this may be invaluable, there are other applications or resistor configurations which require control of current crowding or thermal "hot spots" within the body of the resistor. The Lanning disclosure also lacks features to adjust for variations in thickness or for voids at the interface between resistor and termination, both which are common in screen printed resistors.

Curtis discloses the separation of a single resistor body into several discrete elements which then divide the current flow. The Curtis design limits current crowding with resistor paths having length very nearly equal to diagonal measure. Additionally, current then divides between many locations to reduce the concentration of heating. However, the Curtis disclosure also requires formation of fine lines as opposed to the formation of a single large block. The minimum size of resistive material that may be patterned without complete loss of conductivity due to the formation of voids, micro-cracks or other defects limits applicability of the Curtis disclosure. Further, while the Curtis disclosure does provide for better thermal distribution than the prior art illustrated by Curtis, there are still many discrete regions (as opposed to one) that may be elevated to harmful or destructive temperatures during a transient surge. In effect, this design does not eliminate the electro-thermal heating at the terminations, but rather divides one "hot spot" into several spots.

Landry et al. disclose the use of multiple layers of high resistance material to reduce current crowding resulting from voids, non-homogeneity, and geometry irregularities such as surface roughness and thickness of deposited films. However, the Landry et al. resistor requires completely compatible and migration-free materials to prevent resistance drift with environmental cycling. Further, in screen printing applications, the use of multiple layers implies a very thick resistive film that uses excessive material and may be more likely to form cracks during firing and operation. Additionally, Schelhorn has identified the migration of conductive during multi-step firing as another concern for the Landry et al. design.

Schelhorn et al. disclose the formation of a first relatively conductive resistor material that extends between electrical terminations and a second resistor material of relatively greater resistance applied over the first resistor material. This combination is said to offer many of the advantages of the Landry et al. disclosure without the expense and loss of yield associated with multiple firing processes. Both materials of the Schelhorn et al. disclosure must be present virtually from one terminal to another. This co-extensive application may carry a large materials expense, particularly in those situations that require precious metal materials and sizable resistors. Additionally, the Schelhorn resistor may experience greater resistance drift with environmental cycling if the two resistive materials are not completely compatible and free from migration. In summary, while migration during firing may be reduced in comparison with the Landry et al. disclosure, the large material usage associated with the second high resistance layer and the drawbacks inherent to both the Landry and Schelhorn design makes these approaches less than ideal.

In summary, the prior art is limited to particular geometries or configurations that are not applicable to the field of electrical resistors in general.

SUMMARY OF THE INVENTION

The present invention overcomes the limitations of the prior art by incorporating a relatively conductive material in parallel with a resistor material at each region where electro-thermal energy is otherwise potentially destructive. Current which would otherwise travel exclusively through the resistor material is rerouted in large part to the more conductive material. Since power is inversely related to resistance, rerouting the current flow through a composition of lower resistivity reduces the dissipation of power at the anticipated hot spots. Since the conductive composition is applied only to relatively small discrete locations and the resistive material continues throughout without interruption, there is very little shift in the total resistance of the element from the introduction of these conductive compositions.

DESCRIPTION OF THE PREFERRED EMBODIMENT

Figure 1:
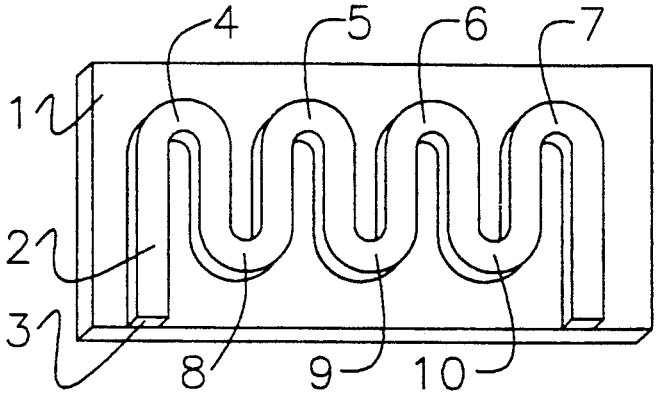
FIGURE 1 (PRIOR ART)
FIG. 1 illustrates a prior art figure of a resistor patterned upon a substrate.

FIG. 1 illustrates a typical prior art resistor. A substrate 1 is typically fashioned from a non-conductive material such as from a polymer material or from a ceramic. Upon this substrate a resistor 2 is patterned to form a film type resistor. The resistor 2 in FIG. 1 has a serpentine pattern, although other patterns, such as block resistors or spiral designs, might be applied by one of ordinary skill familiar with resistors. This particular serpentine has curves formed in the conductive pattern 2 designated by the numerals 4–10. The resistor additionally has terminations designated by the numeral 3. Power is generally applied through the terminations 3, resulting in a flow of current through resistor 2. At each curve 4–10, current flow usually concentrates at the inside part of the curve, seemingly taking the shortest path around the curves. Since according to Ohm's law power dissipation is equal to the amount of current flow divided by resistance, power dissipation is localized toward the inside of each of the curves 4–10. During the application of a large surge of power, such as might be applied during a lightning strike, the heating of the resistor material at these curves is sometimes sufficient to cause destructive failure. Alumina substrates typically crack and fly apart, while polymer substrates may melt or ignite. A violent failure of the resistor is clearly undesirable and ways have been sought to resolve this problem.

The present invention eliminates destructive localized heating through the use of relatively small "dots" of conductive material. These dots may take various forms and dimensions as required by the application, such as the dots 11 and 12 of FIG. 2. Resistor material 4 and substrate 1 form a sandwich around large dot 11 in FIG. 2, although the layering could take any configuration, so long as large dot 11 is in direct contact with conductor 2. Large dot 11 shunts current from conductor 2 through dot 11. When a surge of power is applied to conductor 2, very little heating occurs at curve 4 because of the shunting action of dot 11. Applying Ohm's law as before, since dot 11 lowers the resistance of curve 4, the power dissipation in the region occupied by dot 11 is reduced. A designer is free to control the placement of these dots to any region that heats excessively during a power surge. Further the conductivity of the dot may be controlled to provide relatively even heating of the region occupied by dot 11, or to maintain the region in a relatively cool state during surge, as desired by the designer. Using the large dot 11, the conductivity of the dot must generally be close to the conductivity of conductor 31 to avoid the shunting of current through dot 11 without a simultaneous reduction in localized power dissipation. For example, if the dot 11 is too conductive, localized heating will still occur at the sharp angle formed between dot 11 and conductor 2 at the innermost edges of curve 4. Further, if dot 11 is too resistive, insufficient shunting will occur and curve 4 will continue to heat with negligible benefit from dot 11. A dot may be composed of termination material and may be formed simultaneous with terminations, although this is not necessary and would only be desirable in those instances where the termination material and the resistor material could be designed to have appropriate relative conductivity.

The formation of the dot shunting conductor 2 accomplishes several benefits that the prior art does not teach. The complete termination of resistors such as Lanning and Curtis illustrate does not overcome current crowding that originates with the presence of voids in either the resistive or conductive compositions. These effects of these voids are difficult to eliminate, other than by the formation of multiple layers illustrated by Landry et al., yet the voids are a significant source of failure in many film components. By having a shunting path of relatively large area, any voids present will not significantly affect the performance of the finished resistor.

While others including Schelhorn teach the use of multiple layers, these layers extend from one termination to another and do not address localized current crowding. The use of layers from one termination to the other wastes valuable and often very expensive conductive composition, and, in those instances where there is significant current crowding, will not overcome component failure upon exposure to surge.

Figure 2:
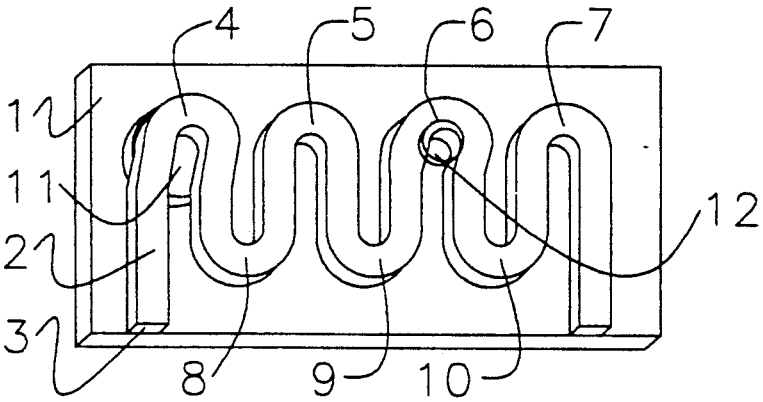
FIG. 2 illustrates a resistor similar to the prior art resistor of FIG. 1 which incorporates some alternative embodiments of the features of the present invention.

Small dot 12 shown in FIG. 2 is similar to large dot 11, with only a change in dimension. Dot 12 might be useful for those applications where very little change in overall resistance of the element is desirable, yet surge durability is still a requirement. Additionally, the incorporation of a relatively small dot is least likely to adversely affect drift of the overall resistance value during testing or aging and will be least likely to be affected by migration of materials.

Figure 3:
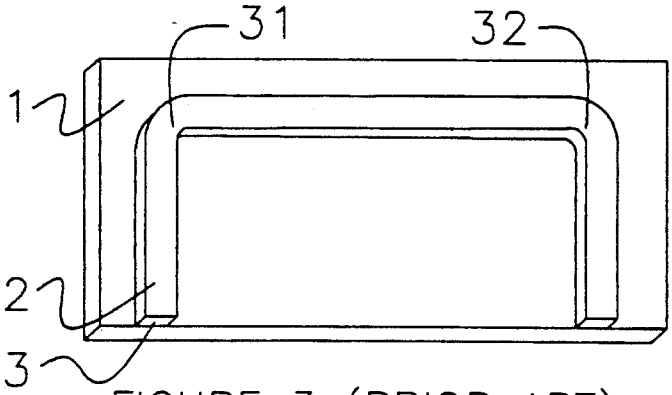
FIGURE 3 (PRIOR ART)
FIG. 3 illustrates a second prior art resistor.
Figure 4:
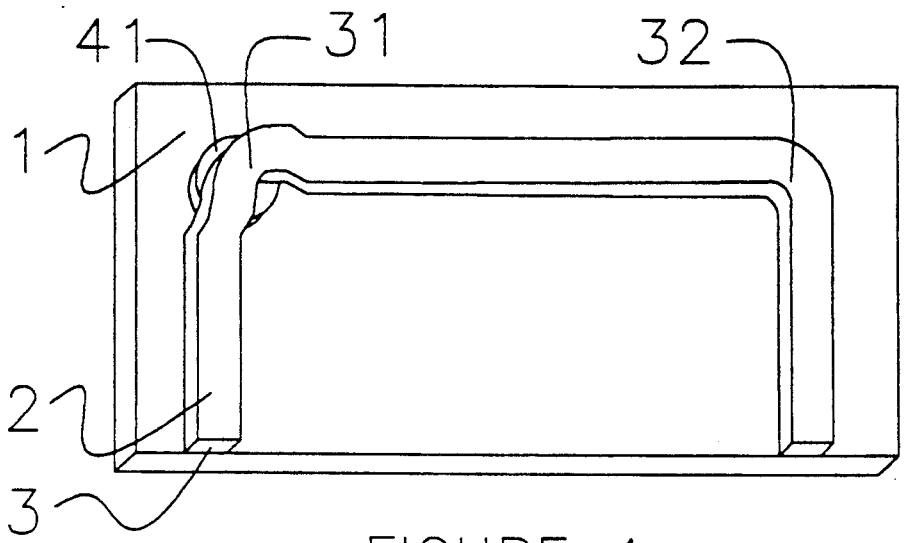
FIG. 4 illustrates a second resistor similar to the prior art resistor of FIG. 3 which incorporates some features of the present invention.

FIG. 3 illustrates an alternative application wherein a single film resistor is shown which has only two right angle curves 31 and 32. A device of this nature might be used as a shorting bar or a low value resistor. When exposed to surge, these curves are likely sources of failure due to current crowding, although not as significant as curves 4–10. To prevent failure from occurring during surge at curve 31, a dot of conductive 41 may be applied at curve 31. In FIG. 4 the dot is sandwiched between substrate 1 and conductive 2, although this is not necessary. The dot may be formed by any heretofore known technique, including but not limited to masking and plating, vapor depositing, screen printing, or, if applications merit, even imbedding into the substrate.

Figure 5:
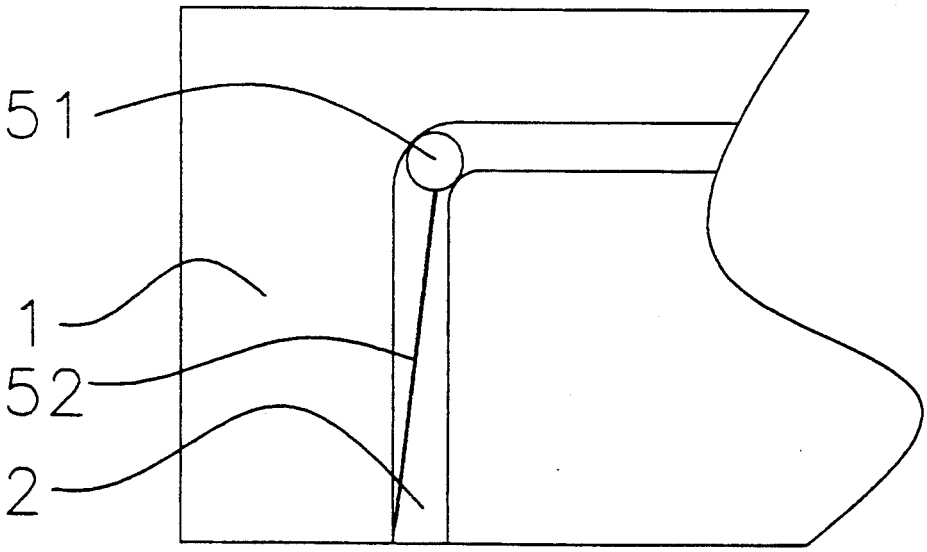
FIG. 5 illustrates a resistor similar to the resistor of FIG. 4 from a top view, in an alternative embodiment.

Smaller dot 51 offers a particular design advantage illustrated from top view in FIG. 5. Dot 51 is centered within curve 31. The shortest path for current flow from one edge of termination 3 is illustrated by dotted line 52. By making dot 5 roughly tangent to the inside of curve 31, current will be much more evenly divided throughout surrounding conductive 2. While some current may still pass entirely through the resistive at the inside of curve 31, much of the current will be shunted around without destructive energy dissipation.

While the invention has been illustrated and described in the preferred embodiment for application to planar film type resistors, the invention is applicable to a variety of resistors. The conductive dot may be applied or formed into composition resistors, and may be formulated to have resistance characteristics that are best suited to the application. The dot will generally be more conductive than conductor 2, although this does not have to be the case. Thermal modeling or actual prototype testing may be used to determine the heating characteristics of the substrates and the appropriate value of shunt resistance. Typically the conductivity of the dot and the material will not be too widely differing, or the resultant product will effectively have a termination at the closest intersection between the two materials and will be accompanied by the drawbacks associated with a termination.

While the foregoing details what is felt to be the preferred embodiment of the invention, no material limitations to the scope of the claimed invention are intended. Further, features and design alternatives that would be obvious to one of ordinary skill in the art ar considered to be incorporated herein if not discussed herein. The scope of the invention is set forth and particularly described in the claims hereinbelow.

We claim:

1. A composite electrical component having a finite resistance to current flow comprising a first conductive material having two terminations, said first conductive material being electrically continuous between said two terminations, said first conductive material having first relatively localized regions therein prone to failure or causing second relatively localized regions of said composite electrical component to fail during the application of large surges of electrical energy between said two terminations, the improvement comprising second conductive material located adjacent to said first and said second relatively localized regions and electrically connected to said first conductive material to shunt current from said first conductive material through said second conductive material while not disrupting the electrical continuity of said first conductive material between said two terminations, said second conductive composition limited in size and placement substantially to said first and said second relatively localized regions.

2. The composite electrical component of claim 1 wherein said first conductive composition comprises an elongated pattern having a length and width, said length being substantially greater than said width, and wherein said second conductive material extends a first distance along said length of said first conductive composition in a region of said conductor located near a center of said width and a second distance along said length of said first conductive in a region of said conductor located near an edge of said width, said first distance having a magnitude greater than a magnitude of said second distance.

3. The composite electrical component of claim 2 wherein said second conductive material is configured as a generally round dot.

4. The composite electrical component of claim 1 wherein said first conductive material is configured in a non-linear pattern having a turn therein between said terminations, said turn including said second conductive material adjacent thereto, said current flow through said first conductive material distributed substantially evenly therein in those regions not immediately adjacent said second conductive material.

5. The composite electrical component of claim 4 wherein said current flow through said first conductive material is partially shunted by said second conductive material in those regions adjacent said second conductive material.

6. A composite electrical component having a finite resistance to current flow comprising a first electrically conductive material having two terminations, said first conductive material being electrically continuous between said two terminations, said first conductive material having first relatively localized regions therein prone to failure or causing second relatively localized regions of said composite electrical component to fail during the application of large surges of electrical energy between said two terminations, the improvement comprising second electrically conductive material located adjacent to and substantially electrically connected throughout said first relatively localized regions and electrically connected to said first conductive material to shunt current from said first conductive material through said second conductive material and returning said current to said first conductive material while not disrupting the electrical continuity of said first conductive material between said two terminations, said second conductive composition limited in size and placement substantially to said first and said second relatively localized regions thereby reducing the quantity of electrical energy passing through said first conductive material in said localized regions while not significantly altering the amount of current flowing between said two terminations.

7. The composite electrical component of claim 6 wherein said first conductive composition comprises an elongated pattern having a length with width, said length being substantially greater than said width, and wherein said second conductive material extends a first distance along said length of said first conductive composition in a region of said conductor located near a center of said width and a second distance along said length of said first conductive in a region of said conductor located near an edge of said width, said first distance having a magnitude greater than a magnitude of said second distance.

8. The composite electrical component of claim 7 wherein said second conductive material is configured as a generally round dot.

9. The composite electrical component of claim 6 wherein said first conductive material is configured in a non-linear pattern having a turn therein between said terminations, said turn including said second conductive material adjacent thereto, said current flow through said first conductive material distributed substantially evenly therein in those regions not immediately adjacent said second conductive material.

10. The composite electrical component of claim 9 wherein said current flow through said first conductive material is partially shunted by said second conductive material in those regions adjacent said second conductive material.

11. A film type resistor formed as a first layer primarily upon an electrically insulating substrate and having two terminations electrically connected to said resistor, said resistor carrying a first current introduced at a first of said terminations to a second of said terminations, said resistor having a relatively localized region prone to electro-thermally induced failure upon passage of said first current, the improvement comprising a second resistor formed as a second layer adjacent only to said localized region and forming a laminate with said first layer in said region, said second resistor electrically interconnected to said first resistor substantially throughout a surface of said second layer, a portion of said current passing through said localized region shunted to said second resistor, said first and said second resistor thereby carrying said first current between said terminations without said electro-thermally induced failure.

12. The composite electrical component of claim 11 wherein said first conductive composition comprises an elongated pattern having a length and width, said length being substantially greater than said width, and wherein said second conductive material extends a first distance along said length of said first conductive composition in a region of said conductor located near a center of said width and a second distance along said length of said first conductive in a region of said conductor located near an edge of said width, said first distance having a magnitude greater than a magnitude of said second distance.

13. The composite electrical component of claim 12 wherein said second conductive material is configured as a generally round dot.

14. The composite electrical component of claim 11 wherein said first conductive material is configured in a non-linear pattern having a turn therein between said terminations, said turn including said second conductive material adjacent thereto, said current flow through said first conductive material distributed substantially evenly therein in those regions not immediately adjacent said second conductive material.

15. The composite electrical component of claim 14 wherein said current flow through said first conductive material is partially shunted by said second conductive material in those regions adjacent said second conductive material.

* * * * *